United States Patent [19]

Morana

[11] Patent Number: 4,546,689

[45] Date of Patent: Oct. 15, 1985

[54] SHEET MUSIC HOLDER

[76] Inventor: Frank J. Morana, 18 Robertson Rd., West Orange, N.J. 07052

[21] Appl. No.: 490,256

[22] Filed: May 2, 1983

[51] Int. Cl.[4] ..... G10G 7/00

[52] U.S. Cl. ..... 84/505; 40/531

[58] Field of Search ..... 248/441 R, 450, 451, 248/452, 458; 281/42; 40/531, 532, 533; 84/489, 502–507, 516

[56] References Cited

U.S. PATENT DOCUMENTS

| | | | |
|---|---|---|---|
| 390,800 | 10/1888 | Palmer | 248/451 |
| 475,393 | 5/1892 | Frankel | 84/502 |
| 556,579 | 3/1896 | Leach | 248/452 |
| 592,021 | 10/1897 | Robbins | 84/505 |
| 791,463 | 6/1905 | Gordon | 248/452 |
| 978,043 | 12/1910 | Lindsay | 84/516 |

FOREIGN PATENT DOCUMENTS

| | | | |
|---|---|---|---|
| 557656 | 1/1972 | Switzerland | 248/452 |
| 2073710 | 10/1981 | United Kingdom | 40/531 |

*Primary Examiner*—J. Franklin Foss
*Assistant Examiner*—Robert A. Olson
*Attorney, Agent, or Firm*—Carella, Byrne, Bain & Gilfillan

[57] ABSTRACT

There is disclosed a novel music sheet holder for a book having a front and a back cover, a spine and individual pages, comprising a body member having a shaft member, a first pair of outer leg members downwardly extending from the shaft member and second leg member extending downwardly from the shaft member and positioned intermediately to the first pair of outer leg members; a clip member under spring tension mounted on the outer leg members of the body member; an arm member having a body portion, an arm portion extending horizontally from the body portion, a vertical plate portion on an end of the arm portion opposite the body member and a manipulative handle extending perpendicularly upwardly from the body portion on an end of the body portion opposite the arm portion, the arm member being rotatably positioned on the shaft member of the body member. The sheet music holder is further comprised of a sheet retaining member slidably mounted on the vertical plate portion of the arm member and a spring member having a pair of elongated rods cooperatively engageable with the outer leg members of the body member and the body portion of the arm member which allows selective rotation of the arm member.

17 Claims, 3 Drawing Figures

SHEET MUSIC HOLDER

FIELD OF THE INVENTION

This invention relates to a sheet music holder and more particularly to a sheet music holder that assists a musician by improving one's ability to turn a page.

BACKGROUND OF THE INVENTION

One of the primary concerns of a musician during a performance is his or her ability to mount the sheet music and also to be able to turn the respective pages as the musical piece is performed.

To accomplish this task, musical stands were introduced wherein the book of sheet music could be positioned therein easing the burden of the musician. Although, the music book could now be positioned on a stand, a new problem arose in that when the book was opened to the respective page, the other pages tended to flutter or turn based upon the stiffness of the book. To overcome this problem a musician would have to either bend, deform or break the binding of the book to control the movement of the pages. An alternative remedy was removing the pages of the book thereby having single sheets. This would tend to solve one problem but cause another since the single sheets are susceptible to being lost.

Assuming that a musician is able to control his book of sheet music, another problem arises, that is, the ability to turn the pages of the music book while performing. During a performance or recital, a musician when turning the page is susceptible to knocking over the book, turning to the wrong page or if he turns to the correct page have the pages flutter thereby causing the musician to have to once again alter the music book in some fashion to have the right sheet of music in front of him or her.

OBJECTS OF THE INVENTION

An object of the present invention is to provide a novel sheet music holder.

Another object of the present invention is to provide a novel sheet music holder for holding a sheet music book without bending, deforming or removing sheets of music.

Yet another object of the present invention is to provide a novel sheet music holder for stabilizing a sheet music book.

Still yet another object of the present invention is to provide a novel sheet music holder which simplifies turning the pages of sheet music.

SUMMARY OF THE INVENTION

These and other objects of the present invention are achieved by a novel music sheet holder for a book having a front and a back cover, a spine and individual pages, comprising a body member having a shaft member, a first pair of outer leg members downwardly extending from the shaft member and second leg member extending downwardly from the shaft member and positioned intermediately to the first pair of outer leg members; a clip member under spring tension mounted on the outer leg members of the body member; am arm member having a body portion, an arm portion extending horizontally from the body portion, a vertical plate portion on an end of the arm portion opposite the body member and a manipulative handle extending perpendicularly upwardly from the body portion on an end of the body portion opposite the arm portion, the arm member being rotatably positioned on the shaft member of the body member. The sheet music holder is further comprised of a sheet retaining member slidably mounted on the vertical plate portion of the arm member and a spring member having a pair of elongated rods cooperatively engageable with the outer leg members of the body member and the body portion of the arm member which allows selective rotation of the arm member.

BRIEF DESCRIPTION OF THE DRAWING

A better understanding of the present invention as well as other objects and advantages thereof, will become apparent upon consideration of the detailed disclosure thereof, especially when taken with the accompanying drawings wherein.

DETAILED DESCRIPTION OF THE INVENTION

Figure 1:
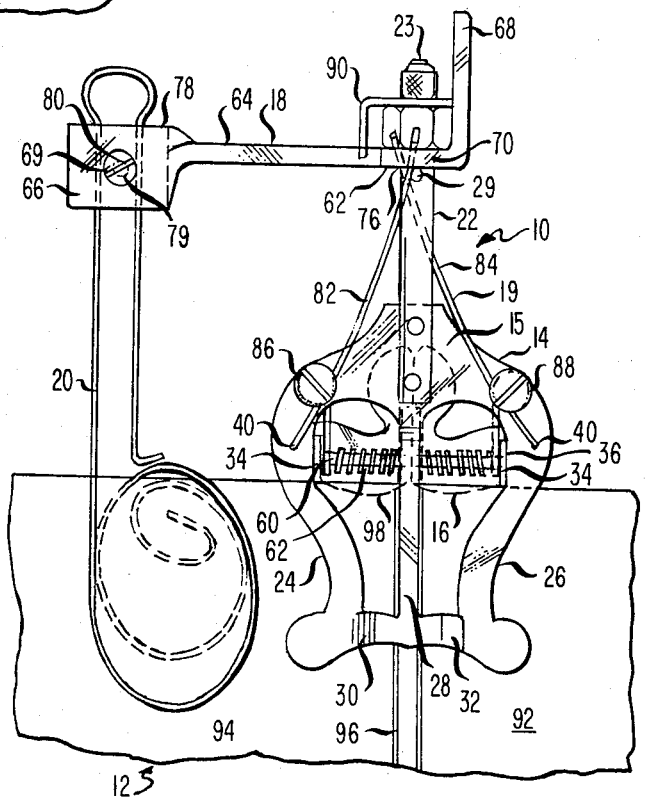
FIG. 1 is a rear elevational view of the present invention.

Referring now to FIG. 1, there is shown a music sheet holder, generally indicated as 10, positioned on a book of sheet music, generally indicated as 12. Music sheet holder 10 is comprised of a body member 14, a clip member 16, an arm member 18, a spring member, generally indicated as 19, and a sheet retaining member 20.

Body member 14 is comprised of a shaft member 22 having an upper threaded end 23, cross member 15 affixed to the opposite end of the shaft member 22, outer leg members 24 and 26 downwardly extending from the cross member 15, intermediate leg member 28, downwardly extending from the shaft member 22, and bridge members 30 and 32 connecting the terminal ends of outer leg members 24 and 26 with intermediate leg member 28. In the preferred embodiment of the present invention, intermediate leg member 28 is offset from and not in the same plane as outer leg members 24 and 26. Additionally as more fully hereinafter discussed, shaft member 22 is provided with a stop pin 29 on an end opposite leg members 24, 26 and 28.

Perpendicularly extending from the outer leg members 24 and 26 and in a direction away from intermediate leg member 28 are shoulder members 34. Each of the shoulder members 34 are formed with an orifice 36, as more fully hereinafter discussed. Further, as more fully hereinafter discussed, each of the outer leg members 24 and 26 are formed with an upper threaded orifice 38 and lower orifice 40.

Figure 2:
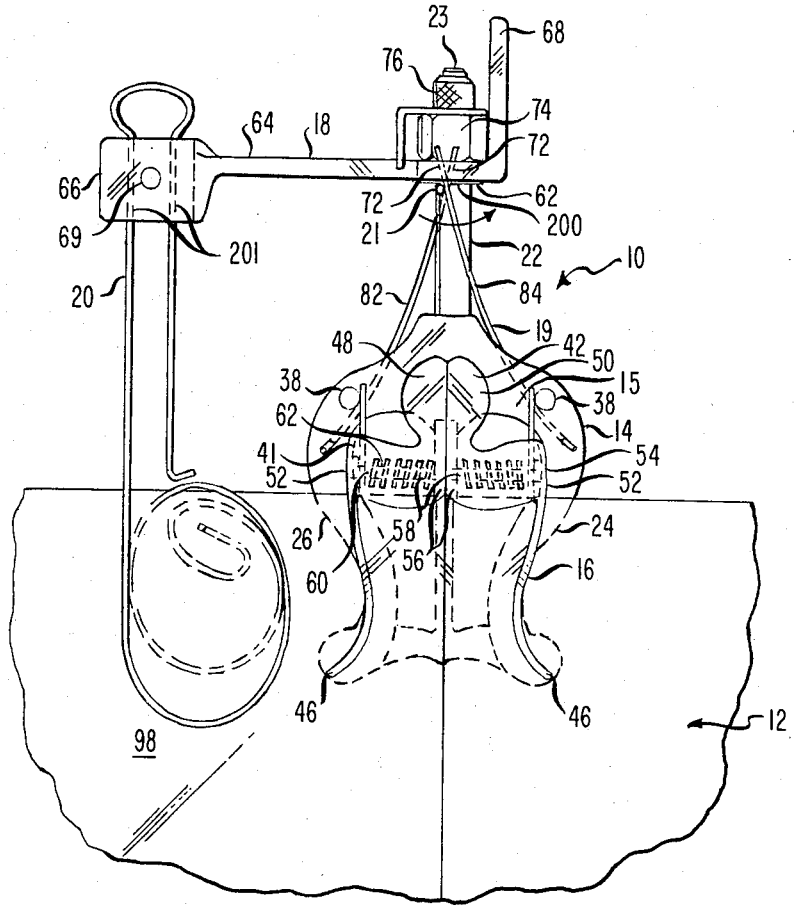
FIG. 2 is a front elevational view of the present invention.

Referring now to FIG. 2, there is shown clip member 16 positioned on body member 14. Clip member 16 is comprised of head member 42, a body 44 and two downwardly extending leg members 46. Clip member 16 can be of unit body construction, or as shown in the preferred embodiment can be comprised of two mirror image members 48 and 50, each mirror image comprising one half of the head member 42, one half of the body 44 and each having one leg member 46. As more fully hereinafter discussed, if the clip member 16 is of unitary construction, body 44 is provided with two outer perpendicularly extending shoulder members 52, wherein each of the shoulder members is provided with an orifice 54. If clip member 16 is of a two part construction, each half of the body is provided with the outer perpendicularly extending shoulder member 52 with the orifice 54 and also is provided with an inner perpendicularly extending shoulder member 56 parallel to the outer perpendicularly extending shoulder member 52. Inner shoulder member 56 is provided with an orifice 58, which orifice 58 is in alignment with orifice 54 of outer shoulder member 52.

Clip member 16 is mounted on body member 14 through the use of a pin 60 and a spring 62 to achieve spring tension on clip member 16. If clip member 16 is of unitary construction pin 60 is inserted through orifice 54 of outer shoulder member 52 on clip member 16, then through orifice 36 of shoulder 34, spring 62 is then positioned on pin 60 followed by pin 60 being inserted through mirror orifices 36 and 54 on body member 14 and clip member 16. If clip member 16 is of two part construction pin 60 is inserted through orifices 54 and 36, then a first spring 61 is placed thereon and the pin 60 is then inserted through orifices 58 formed on inner shoulder members 56 followed by the insertion thereon of a second spring 61 and terminating through orifices 36 and 54.

Arm member 18 is comprised of a body portion 62, a horizontal arm 64 extending from the body portion, a vertical plate portion 66 at the terminus of the horizontal arm 64 and a manipulative handle 68 extending perpendicularly upwardly from the body portion 62 on a side of the body portion 62 opposite the horizontal arm 64. Vertical plate portion 66 is provided with a centrally positioned orifice 69. Body portion 62 is formed with a centrally positioned orifice 70 and a pair of oppositely aligned orifices 72 flanking orifice 70. Arm members 18 is positioned on body member 14 by inserting shaft member 22 up to stop pin 29 into orifice 70. Arm member 18 is then affixed to shaft member 22 through the use an intermediate nut 74 and a restraining nut 76 which are threadably engaged with the upper threaded end 23 of shaft member 22. To prevent metal to metal contact plastic washers 200 are inserted between the stop pin 29 and body portion 62 and body portion 62 and intermediate nut 74.

Sheet retaining member 20 is mounted on vertical plate portion 66 of arm member 18 through the use of a mounting plate 78. Mounting plate 78 is provided with a centrally positioned orifice 79 which is aligned with orifice 69 on vertical plate 66 and then attached by a screw or other mounting means 80. Mounting plate 78 is further provided with channels 201 to provide for the slidable mounting of sheet retaining member 20 when so affixed. Mounting plate 78 can be formed from a thermoplastic or metallic material.

Spring members 19 are comprised of two elongated rods 82 and 84 which are each positioned in one of the flanking orifices 72 in body portion 62 of arm member 18 and extend downwardly and are inserted within each of the lower orifices 40 formed on outer leg members 24 and 26 of body member 14. Tension on rods 82 and 84 is provided by screws 86 and 88 which are threadly engaged in upper threaded orifices 38 formed on outer leg members 24 and 26.

As a precautionary measure, a shield 90 can be affixed to arm member 18 to cover the exposed ends of rods 82 and 84 which extend upwardly through orifice 72 of body portion 62.

Referring back to FIG. 1, the present invention is utilized with a book of sheet music 12 having a front cover 92, a back cover 94, a spine 96 and pages 98. Body member 14 is mounted on book 12 by inserting leg members 46 of clip member 16 between the last pages 98 of the book and the front cover 92 and back cover 94 of book 12 such that the spine 96 of book 12 rests on the intermediate leg member 28 of body member 14 and the front cover 92 and back cover 94 rest on the outer leg members 24 and 26 respectively. Sheet retaining member 20 is attached to the page that is to be turned. When the musician wishes to turn the page, he clasps manipulative handle 68 and rotates the arm member 18 180° thereby rotating rods 82 and 84 and thereby exposing the next desired page as shown in FIG. 2. The rotation of the manipulative handle 68 can only be 180°, since stop pin 29 will abut either of the two rods 82 and 84. As an alternative, leg members 46 of clip member 16 can be placed on internal pages 98 of the book 12 rather than on the inside of front cover 92 or back cover 94.

Figure 3:
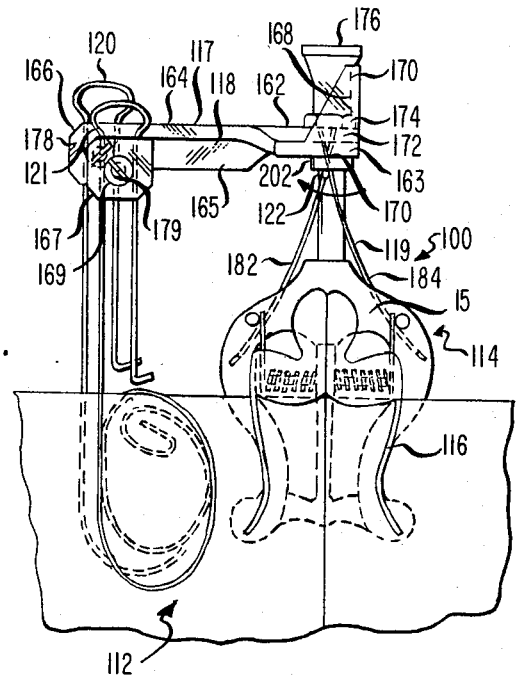
FIG. 3 is a front elevational view of another embodiment of the present invention.

Referring now to FIG. 3, there is shown an alternative embodiment of the present invention whereby more than one page of a sheet music book can be turned during use wherein the music sheet holder, generally indicated as 100 is comprised of a body member 114, clip member 116, a pair of arm members 117 and 118, a spring member, generally indicated as 119 and sheet retaining members 120 and 121. Body member 114 and clip member 116 are comprised identically as the previously described embodiment.

Arm members 117 and 118 are each comprised of a body portion 162 and 163 respectively, a horizontal arm 164 and 165 respectively, a vertical plate portion 166 and 167 respectively, and a manipulative handle 168 and 170 extending perpendicularly upward from the body portion 162 and 163. As in the previously described embodiment, vertical plate portion 166 and 167 of each arm member 117 and 118 is provided with a centrally positioned orifice 169 for positioning a mounting plate 178 and 179 for slidably mounting the sheet retaining members 120 and 121. Body portion 162 and 163 are each formed with an offset positioned orifice 170 for inserting shaft member 122 of body member 114 to affix the arm members 117 and 118 thereto through the use of an intermediate nut 174 a restraining nut 176 and washers 202. Additionally, each of the arm members 117 and 118 is provided with a single orifice 172 for positioning elongated rods 182 and 184 of spring members 119 therein. Although, the embodiment described only refers to two sheet retaining members 120 and 121; it is understood that more than two sheet retaining members attached to more than two arm members 117 and 118 can be added.

As in the previously described embodiment, body member 114 is mounted on a book 112 through the use of clip member 116. Sheet retaining members 120 and 121 are attached to two subsequent pages of the book 112. When a musician or the like wishes to turn the page, he or she firsts clasps manipulative handle 168 and rotates the arm member 117 180° degrees thereby rotating rod 182 and flipping over the page. To turn then next page, the individual claps manipulative handle 170 and rotates the arm member 118 180° degrees thereby rotating rod 184 and subsequently turning the page.

The sheet music holder described can be formed of metal or other types of durable material.

Numerous modifications and variations of the above disclosed invention are possible in light of the above teaching and, therefore, within the scope of the appended claims, the invention may be practiced otherwise than as particularly described.

What is claimed:

1. A sheet music holder for a book having a front and a back cover, a spine and individual pages comprising:
   (a) a body member having a shaft member extending downwardly to a cross member;
   (b) clip means mounted on said body member and adapted to frictionally grasp the edge of a book;
   (c) an arm member having a body portion rotatably mounted on the shaft member above the cross member, and an arm portion extending outwardly from said body portion;
   (d) sheet retaining means vertically slidably mounted to and depending from the arm portion at a distance from the shaft;
   (e) spring means comprising a pair of elongated resiliently bendable rods one end of each rod being anchored respectively to the cross member on opposite sides of the shaft and the other end of each rod anchored to the said body portion respectively on opposite sides of the shaft; and
   (f) rotation stop means on the shaft extending generally outwardly from the shaft, being generally perpendicular to the cross member, the rods alternately being engageable with the stop means as the arm member is rotated about the shaft member.

2. The sheet music holder as defined in claim 1 further comprising an intermediate leg member on said body member extending downwardly from the shaft member, and a pair of outer leg members extending downwardly from the cross member on opposite sides of the shaft member, said clip means being mounted on said outer leg members of said body member, the intermediate leg being offset from said pair of outer leg members away from said clip means.

3. The sheet music holder as defined in claim 1 wherein said clip means is comprised of a head member, a body member continuous with said head member and a pair of downwardly extending leg members from said body member.

4. The sheet music holder as defined in claim 2 wherein said clip means is comprised of a head member, a body member continuous with said head member and a pair of downwardly extending leg members from said body member.

5. The sheet music holder as defined in claim 1 wherein said clip means is comprised of a pair of mirrored half, each halve having a head member, a body member continuous with said head member and a downwardly extending leg member from said body member.

6. The sheet music holder as defined in claim 2 wherein said clip means is comprised of a pair of mirrored halves, each half having a head member, a body member continuous with said head member and a downwardly extending leg member from said body member.

7. The sheet music holder as defined in claim 1 having a pair of arm members, each having a body portion, independently rotatably mounted to the shaft member above the cross member and an arm portion extending outwardly from said body portion, the body portion of each arm member extending outwardly from the shaft member; sheet retaining means vertically slidably mounted to and depending from the arm portions at a distance from the shaft member; the spring means comprising a pair of elongated, resiliently bendable rods one end of each rod being anchored respectively to the cross member on opposite sides of the shaft and the other end of each rod being anchored respectively to the body portion of an arm member.

8. The sheet music holder as defined in claim 2 having a pair of arm members, each having a body portion, independently rotatably mounted to the shaft member above the cross member and an arm portion extending outwardly from said body portion, the body portion of each arm member extending outwardly from the shaft member; sheet retaining means vertically slidably mounted to and depending from the arm portions at a distance from the shaft member; the spring means comprising a pair of elongated, resiliently bendable rods one end of each rod being anchored respectively to the cross member on opposite sides of the shaft and the other end of each rod being anchored respectively to the body portion of an arm member.

9. The sheet music holder as defined in claim 1 wherein said sheet retaining means comprises a resilient wire having loops on its bottom generally lying in the same plane and an upwardly extending connecting wire vertically slidably mounted to the arm portion at a distance from the shaft.

10. The sheet music holder in accordance with any one of claims 1, 2, 3, 4, 5 and, 6, in which the spring means normally urge the arm to rotate about the shaft until one or the other of the rods engage the stop means.

11. The sheet music holder in accordance with claim 7 or 8 in which the spring means normally urge the arms to rotate about the shaft until one or the other of the rods engage at the stop means.

12. A book holder for a sheet music having a front and a back cover, a spine and individual pages comprising:
   (a) a body member having a shaft member having an upper threaded end, a pair of outer leg members downwardly extending from said shaft member and an intermediate leg member extending downwardly in alignment with said shaft member;
   (b) a clip member under spring tension mounted on said outer leg members of said body member;
   (c) a pair of parallel arm members, each having a body portion, an arm portion extending horizontally from said body portion, a vertical plate portion on an end of each of said arm portions opposite said respective body portions and a manipulative handle extending perpendicularly upward from said body portion on an end of said body portion opposite said arm portion, each body portion of each of said pair of arm members having a first orifice for rotatably positioning said arm members on said shaft member of said body member, and each of said arm members being engageable with a spring member providing for selective rotation of said arm members; and a pair of sheet retaining members, each slidably mounted on said vertical plate portion of said arm member;
   (d) said spring member comprising a pair of elongated rods each having a top and bottom end, each rod being cooperatively engageable with an outer leg member of a body member and a body portion of an arm member which allows selective rotation of said arm member, wherein said body portion of each said arm member is formed with a second orifice adjacent said first orifice for receiving the top end of one of said elongated rods of said spring member and each of said pair of outer leg members on said body member being formed with an orifice for receiving said bottom end of said one of said elongated rods of said spring member.

13. The sheet music holder as defined in claim 12 wherein said intermediate leg member on said body member is offset from said pair of outer leg members away from said clip member mounted on said outer leg members of said body member.

14. The holder as defined in claim 12 wherein said top ends of said elongated rods positioned in said body portion of said arm member are covered by a shield.

15. A book holder for a sheet music having a front and a back cover, a spine and individual pages comprising:

(a) a body member having a shaft member having an upper threaded end, a pair of outer leg members downwardly extending from said shaft member and an intermediate leg member extending downwardly in alignment with said shaft member;

(b) a clip member under spring tension mounted on said outer leg members of said body member;

(c) an arm member having a body portion, an arm portion extending horizontally from said body portion, a vertical plate portion on an end of said arm portion opposite said body portion and a manipulative handle extending perpendicularly upward from said body portion on an end of said body portion opposite said arm portion, said body portion having a first orifice for rotatably positioning said arm member on said shaft member of said body member, said arm member being secured to said shaft member by a means for threadably engaging said upper threaded end of said shaft member;

(d) a sheet retaining member slidably mounted on said verticle plate portion of said arm member; and (e) a spring member comprising a pair of elongated rods each having a top and a bottom end, said rods being cooperatively engageable with said outer leg members of said body member and said body portion of said arm member which allows selective rotation of said arm member, wherein said body portion of said arm member is formed with a pair of oppositely aligned second and third orifices flanking said first orifice for receiving said top ends of said elongated rods of said spring member and each of said pair of outer leg members on said body member being formed with an orifice for receiving said bottom ends of one of said elongated rods of said spring member.

16. The sheet music holder as defined in claim 15 wherein said intermediate leg member on said body member is offset from said pair of outer leg members away from said clip member mounted on said outer leg members of said body member.

17. The sheet music holder as defined in claim 16 wherein said top ends of said elongated rods positioned in said body portion of said arm member are covered by a shield.

* * * * *